US009630766B2

(12) United States Patent
Ogata et al.

(10) Patent No.: US 9,630,766 B2
(45) Date of Patent: Apr. 25, 2017

(54) DISPENSER ASSEMBLY FOR AEROSOL CONTAINER

(71) Applicant: TOYO AEROSOL INDUSTRY CO., LTD., Tokyo (JP)

(72) Inventors: Ken Ogata, Tokyo (JP); Hirokazu Shimizu, Tokyo (JP); Toru Toma, Tokyo (JP); Mitsuo Furusawa, Ibaragi (JP); Takashi Fujie, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 40 days.

(21) Appl. No.: 14/873,793

(22) Filed: Oct. 2, 2015

(65) Prior Publication Data

US 2016/0023839 A1 Jan. 28, 2016

Related U.S. Application Data

(63) Continuation of application No. PCT/JP2013/080703, filed on Nov. 13, 2013.

(30) Foreign Application Priority Data

Apr. 3, 2013 (JP) ..... 2013-077932

(51) Int. Cl.
*B67D 1/08* (2006.01)
*B65D 83/20* (2006.01)
(Continued)

(52) U.S. Cl.
CPC ..... *B65D 83/206* (2013.01); *A45D 34/00* (2013.01); *B65D 83/40* (2013.01); *B65D 83/68* (2013.01); *B05B 15/0208* (2013.01)

(58) Field of Classification Search
CPC ..... B05B 15/02; B05B 15/0208; B65D 83/34; B65D 83/40; B65D 83/205; B65D 83/206; B65D 83/22; B65D 83/68; B65D 83/682
See application file for complete search history.

(56) References Cited

U.S. PATENT DOCUMENTS 3,831,804 A * 8/1974 Focht ..... B65D 83/40 220/284
4,053,090 A 10/1977 Kelly et al.
(Continued)

FOREIGN PATENT DOCUMENTS

EP 2982615 A1 2/2016
JP 2001-278369 A 10/2001
(Continued)

OTHER PUBLICATIONS

International Search Report dated Feb. 18, 2014, issued in corresponding application No. PCT/JP2013/080703.

*Primary Examiner* — Patrick M Buechner
(74) *Attorney, Agent, or Firm* — Westerman, Hattori, Daniels & Adrian, LLP

(57) ABSTRACT

The dispenser assembly for an aerosol container includes a fixing plate 10 mounted to an aerosol container 2 that has two stems 6, a nozzle 40 for discharging the contents via two connection parts 47 that respectively lead to the stems 6 and via one discharge tube 42, and a cover member covering the nozzle 40 and held by engagement with the fixing plate 10. The cover member includes a lower cover 20 having a first engaging piece 25, and an upper cover 30 having a second engaging piece 33. The lower cover 20 has a pressing portion 26 that is supported via a hinge ha and pushes on the second engaging piece 33 to disengage the second engaging piece from the second engaging hole 27.

4 Claims, 11 Drawing Sheets

B-B CROSS SECTION

(51) Int. Cl.

| | |
|---|---|
| ***B65D 83/40*** | (2006.01) |
| ***B65D 83/68*** | (2006.01) |
| ***A45D 34/00*** | (2006.01) |
| *B05B 15/02* | (2006.01) |

(56) References Cited

U.S. PATENT DOCUMENTS

| | | | | |
|---|---|---|---|---|
| 5,027,982 | A * | 7/1991 | Demarest | B65D 83/205 222/182 |
| 5,971,226 | A * | 10/1999 | Goncalves | B65D 47/248 222/321.6 |
| 2002/0117516 | A1* | 8/2002 | Lasserre | A45D 19/02 222/145.5 |
| 2004/0134931 | A1* | 7/2004 | Jinbo | B65D 83/68 222/145.6 |
| 2005/0127094 | A1* | 6/2005 | Decottignies | B65D 83/68 222/94 |
| 2005/0184094 | A1* | 8/2005 | Costa | B05B 11/0027 222/153.13 |
| 2006/0065674 | A1* | 3/2006 | Lasserre | B65D 83/68 222/137 |
| 2007/0108231 | A1* | 5/2007 | Gray | B01F 5/0603 222/135 |
| 2007/0235474 | A1 | 10/2007 | Downey et al. | |
| 2013/0175297 | A1* | 7/2013 | Sugimoto | B65D 83/206 222/135 |
| 2015/0251202 | A1* | 9/2015 | Ogata | B65D 83/206 239/418 |

FOREIGN PATENT DOCUMENTS

| | | | |
|---|---|---|---|
| JP | 2001-315861 | A | 11/2001 |
| JP | 2002-193363 | A | 7/2002 |
| JP | 2003-034374 | A | 2/2003 |
| JP | 2004-090990 | A | 3/2004 |
| JP | 2005-41510 | A | 2/2005 |
| JP | 2008-247470 | A | 10/2008 |
| JP | 2009-533289 | A | 9/2009 |
| JP | 2015-009863 | A | 1/2015 |
| WO | 2007/120570 | A2 | 10/2007 |

* cited by examiner

A-A CROSS SECTION

B-B CROSS SECTION

C-C CROSS SECTION

D-D CROSS SECTION

E-E CROSS SECTION

F-F CROSS SECTION

AS VIEWED FROM ARROW G

H-H CROSS SECTION

I-I CROSS SECTION

AS VIEWED FROM ARROW

AS VIEWED FROM ARROW

M-M CROSS SECTION

O-O CROSS SECTION

AS VIEWED FROM ARROW P

DISPENSER ASSEMBLY FOR AEROSOL CONTAINER

TECHNICAL FIELD

The present invention relates to a dispenser assembly for an aerosol container, the assembly including a fixing plate mounted to a mounting cup of the aerosol container, a nozzle having a discharge tube for discharging the content, and a cover member having an operation part for pressing the nozzle and held by engagement with the fixing plate, and more particularly to a dispenser assembly used for an aerosol container containing two types of contents separately and having a total of two stems for discharging the contents.

BACKGROUND ART

As one type of container that holds two-part type hair dyes or hair styling liquids or the like, a dual compartment aerosol container has hitherto been known (see, for example, Patent Document 1), which includes a pair of left and right aerosol containers, a nozzle having two connection parts that lead to the stems of respective aerosol containers and discharging the contents held in respective containers from one discharge tube at the same time, and a cap provided with an operation part for pressing the nozzle. In such a dual compartment aerosol container, the contents remaining in the nozzle may sometimes dry up and clog the nozzle. Therefore, in the container described in Patent Document 1, a passage component that connects to the stems and a head having the nozzle are provided separately and can be separated from each other so that the passage of the contents can be cleaned easily. A tab plate is provided to the passage component for the purpose of removal from the head. The tab plate is formed in a relatively large size for easy removal. The container described in Patent Document 1 is configured such that the tab is accommodated in the gap formed between the two aerosol containers, so that provision of the tab does not result in an increase in the size of the entire container.

PRIOR ART DOCUMENTS

Patent Documents

Patent Document 1: Japanese Patent Application Laid-open No. 2005-41510

SUMMARY OF THE INVENTION

Problems to be Solved by the Invention

Recently, however, aerosol containers that contain two types of contents separately in one container and have two stems are beginning to be used. However, if the design described in Patent Document 1 is applied to such a container, the tab plate mentioned above interferes with and is therefore an obstacle to the mounting cup of the container, so that an increase in the size is inevitable. The head and the passage component mentioned above are attached above and below a main tubular component that is a cover covering the mounting cup, and so there is still some scope of improvement in the assembling work efficiency. To clean the head and passage component, the main tubular component to which the head and passage component are attached needs to be removed from the container, and moreover, the passage component needs to be removed from this main tubular component by inserting a finger therein, because of which the work requires time and effort. Accordingly, a novel dispenser assembly that can be readily mounted to an aerosol container with two stems without causing an increase in size, and that allows easier cleaning of the passage of the contents has been sought after.

The present invention is directed to resolve this issue, an object thereof being to propose a novel dispenser assembly for an aerosol container, which can be readily mounted to an aerosol container with two stems and allows the passage of the contents to be cleaned easily.

Means for Solving the Problems

The present invention resides in a dispenser assembly for an aerosol container, the assembly including:

a fixing plate mounted to a mounting cup of the aerosol container that has two stems;

a nozzle having two connection parts that respectively lead to the stems, and discharging contents from each of the stems through one discharge tube via a passage provided inside the nozzle; and a cover member having an operation part for pressing the nozzle and held by engagement with the fixing plate such as to cover the nozzle, wherein the cover member includes a lower cover located immediately above the fixing plate and having a first engaging piece that engages with a first engaging hole provided to the fixing plate, and an upper cover having the operation part and a second engaging piece that engages with a second engaging hole provided to the lower cover, and the lower cover has a pressing portion that is supported via a hinge and pushes on the second engaging piece to disengage the second engaging piece from the second engaging hole.

Preferably, the nozzle is a two-piece structure in which a lower member provided with the connection parts and an upper member provided with the discharge tube are connected via a hinge such as to be opened and closed.

Preferably, an over cap is provided immediately above the upper cover to cover the discharge tube of the nozzle and the operation part.

Preferably, the over cap includes a cap protrusion that detachably engages with a cover protrusion that is provided to the upper cover or the lower cover, the cap protrusion being provided at four positions, in the front and the back on both sides of an axial line of the discharge tube.

Effects of the Invention

According to the present invention, the dispenser assembly includes a fixing plate mounted to the aerosol container, a nozzle connected to the stems of the container, and a cover member having an operation part for pressing the nozzle and held by engagement with the fixing plate such as to cover the nozzle. The cover member includes a lower cover located immediately above the fixing plate and having a first engaging piece that engages with a first engaging hole provided to the fixing plate, and an upper cover having the operation part for pressing the nozzle and a second engaging piece that engages with a second engaging hole provided to the lower cover. These fixing plate, lower cover, nozzle, and upper cover can all be attached to the aerosol container in this order from the same direction (from above the aerosol container). Alternatively, the lower cover, nozzle, and upper cover may preliminarily be attached to the fixing plate in this order, after which the assembly may be attached to the aerosol container. Namely, these components can readily be mounted, since there is no work of attaching them from above and below a main tubular component as was conventionally done. The lower cover is provided with a pressing portion that is supported via a hinge and abuts on the second engaging piece to disengage the second engaging piece from the second engaging hole, so that, by pressing in this pressing portion, the upper cover can be removed, which in turn allows the nozzle to be removed from above. This way, the nozzle can be cleaned easily.

If the nozzle is a two-piece structure in which a lower member and an upper member are connected via a hinge such as to be opened and closed, the work of cleaning the passage of contents can be performed even more easily.

If an over cap is provided immediately above the upper cover such as to cover the discharge tube of the nozzle and the operation part, unintended discharging of the contents can be avoided since accidental pressing of the pressing portion can be effectively prevented. Also, the amount of dust or the like adhered to the discharge tube will be reduced so that the nozzle will need to be cleaned less frequently.

If the over cap includes a cap protrusion that detachably engages with a cover protrusion that is provided to the upper cover or the lower cover, the cap protrusion being provided at four positions, in the front and the back on both sides of an axial line of the discharge tube, the over cap can be retained more stably.

EXPLANATION OF REFERENCE NUMERALS

Figure 1:
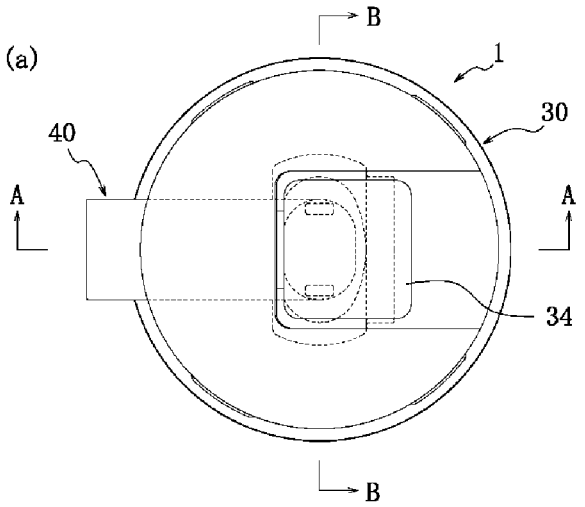
FIG. 1(*a*)-FIG. 1(*b*) illustrate an embodiment of the dispenser assembly for an aerosol container according to the present invention in a state in which the assembly is mounted to the container while the over cap is removed, where FIG. 1(*a*) is a plan view and FIG. 1(*b*) is a side view.
Figure 1B:
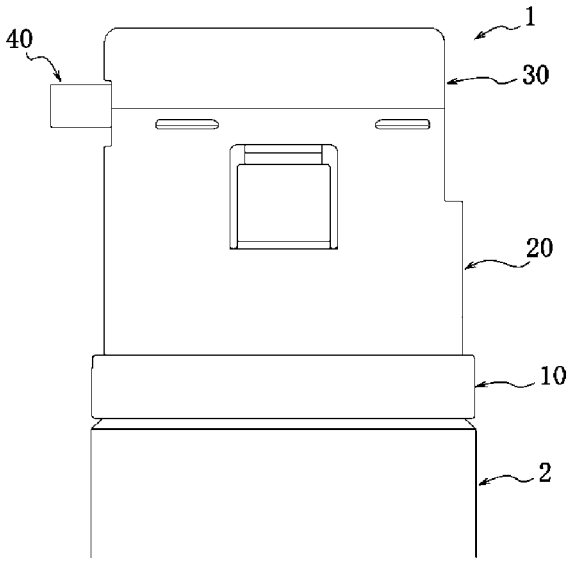

1: Dispenser assembly
2: Aerosol container
4: Mounting cup
6: Stem
10: Fixing plate
17: First engaging hole
20: Lower cover (cover member)
24*b*: Cover protrusion
25: First engaging piece
25*a*: Claw
26: Pressing portion
27: Second engaging hole
30: Upper cover (cover member)
33: Second engaging piece
33*a*: Pressure receiving portion
33*b*: Claw
34: Operation part
40: Nozzle
41: Upper member
42: Discharge tube
45: Lower member
46: Tab
47: Connection part
50: Over cap
53: Cap protrusion
ha: Hinge
hb: Hinge
hc: Hinge
R: Passage

MODES FOR CARRYING OUT THE INVENTION

Hereinafter, the present invention will be described in more detail with reference to the drawings.

Figure 2:
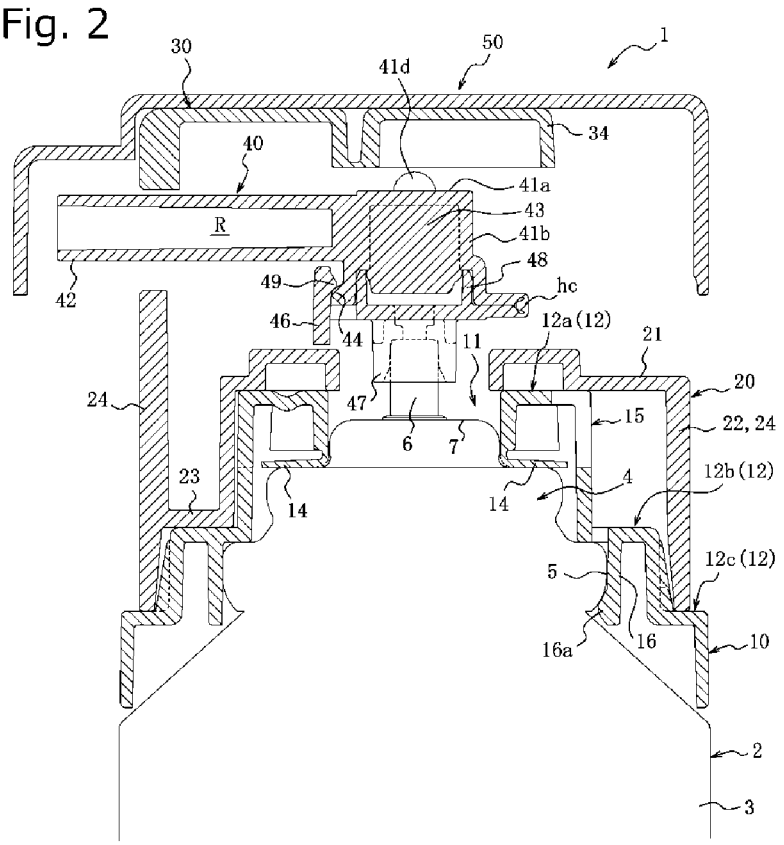
FIG. 2 is an enlarged cross-sectional view of major parts along A-A shown in FIG. 1(*a*), illustrating a state with the over cap mounted.
Figure 3:
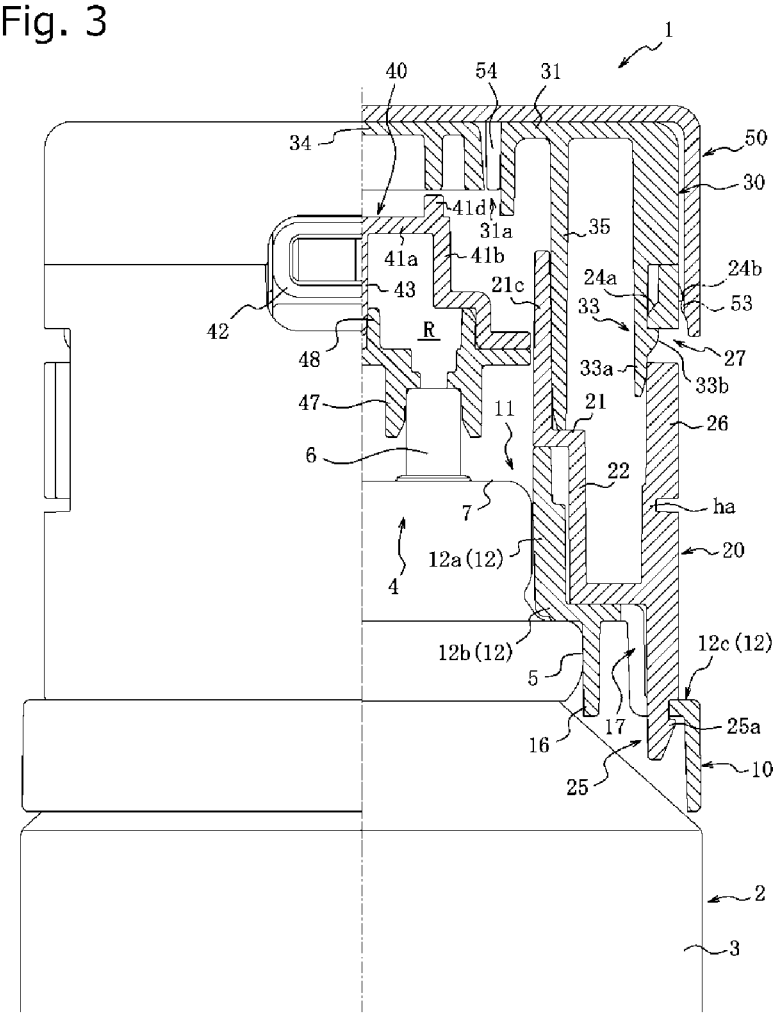
FIG. 3 is an enlarged half cross-sectional view of major parts along B-B shown in FIG. 1(*a*), illustrating a state with the over cap mounted.
Figure 4A:
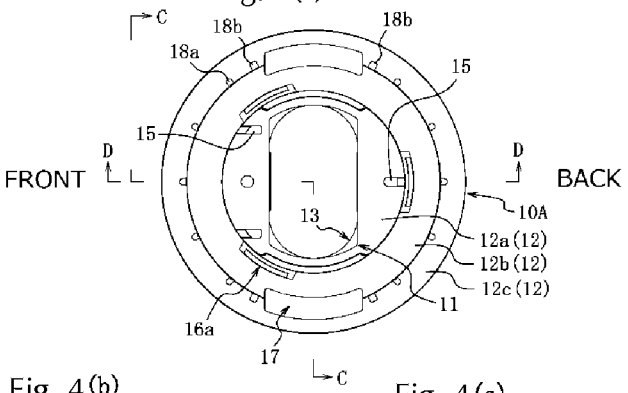
FIG. 4(*a*)-FIG. 4(*d*) illustrate the fixing plate shown in FIG. 1(*a*)-FIG. 1(*b*), where FIG. 4 (*a*) is a plan view, FIG. 4 (*b*) is a half cross-sectional view along C-C of FIG. 4 (*a*), FIG. 4 (*c*) is a cross-sectional view along D-D of FIG. 4 (*a*), and FIG. 4 (*d*) is a bottom view.
Figure 4B:
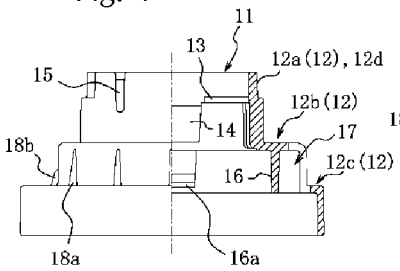
Figure 4C:
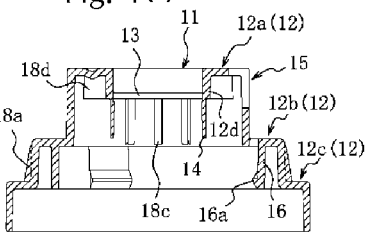
Figure 4D:
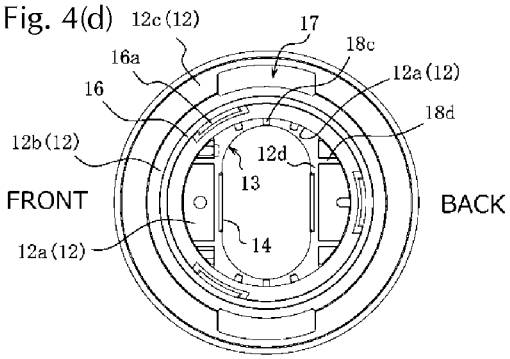
Figure 5:
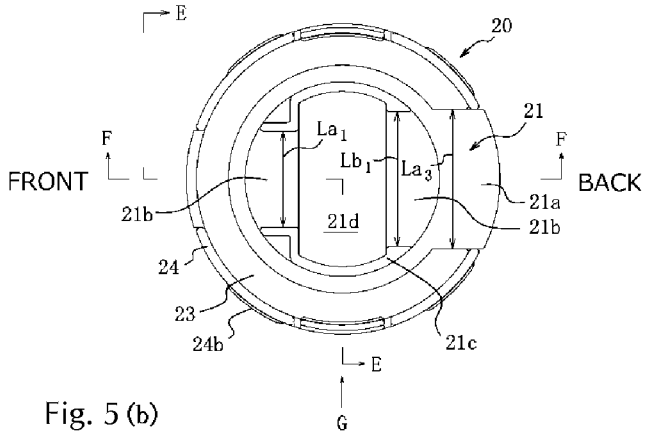
FIG. 5(*a*)-FIG. 5(*c*) illustrate the lower cover shown in FIG. 1(*a*)-FIG. 1(*b*), where FIG. 5(*a*) is a plan view, FIG. 5(*b*) is a half cross-sectional view along E-E of FIG. 5 (*a*), and FIG. 5(*c*) is a cross-sectional view along F-F of FIG. 5(*a*)
Figure 5:
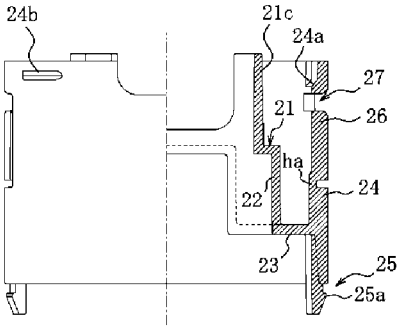
Figure 5C:
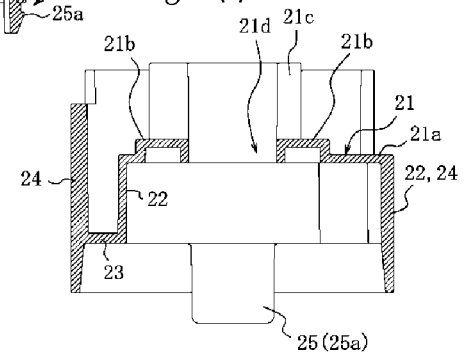
Figure 6:
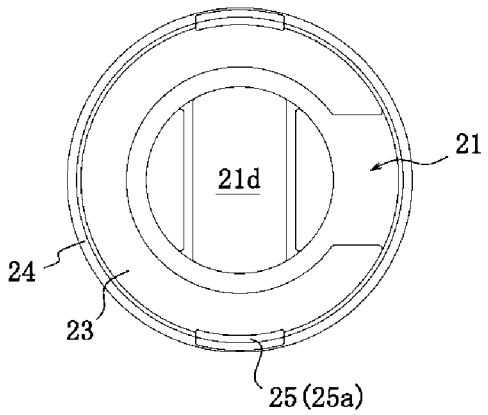
FIG. 6(*a*)-FIG. 6(*b*) illustrate the lower cover shown in FIG. 1(*a*)-FIG. 1(*b*), where FIG. 6 (*a*) is a bottom view and FIG. 6 (*b*) is a view seen from the direction of arrow G of FIG. 5(*a*)
Figure 6:
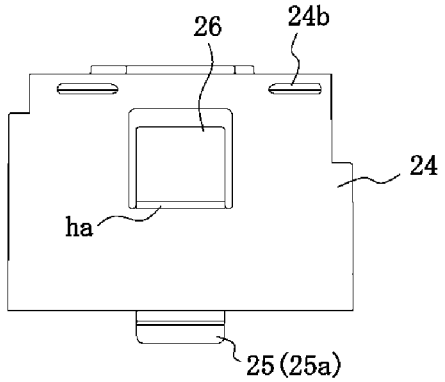
Figure 7:
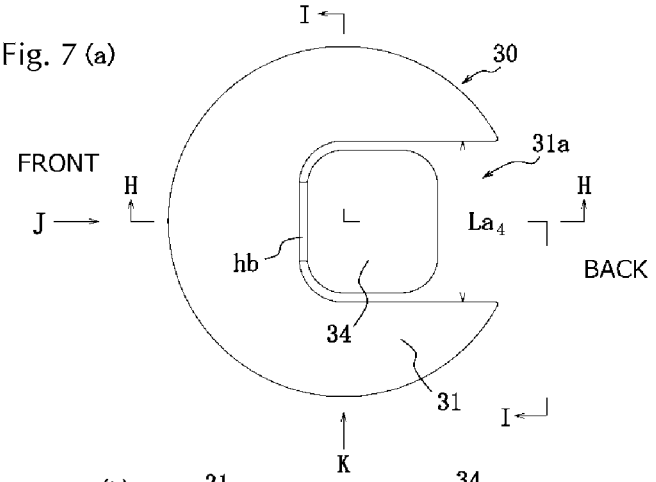
FIG. 7(*a*)-FIG. 7(*c*) illustrate the upper cover shown in FIG. 1(*a*)-FIG. 1(*b*), where FIG. 7(*a*) is a plan view, FIG. 7(*b*) is a cross-sectional view along H-H of FIG. 7(*a*), and FIG. 7(*c*) is a half cross-sectional view along I-I of FIG. 7 (*a*)
Figure 7:
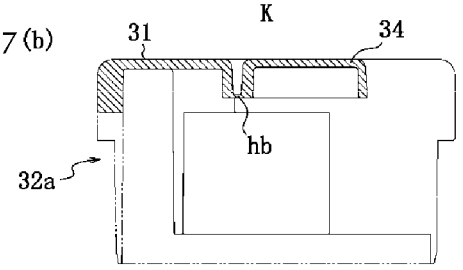
Figure 7:
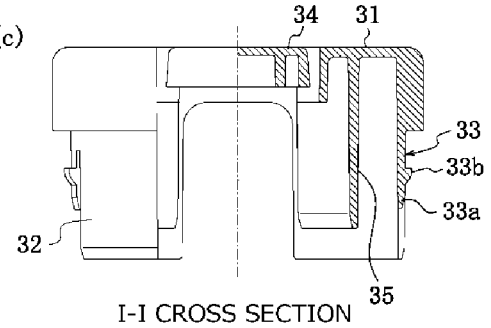
Figure 8:
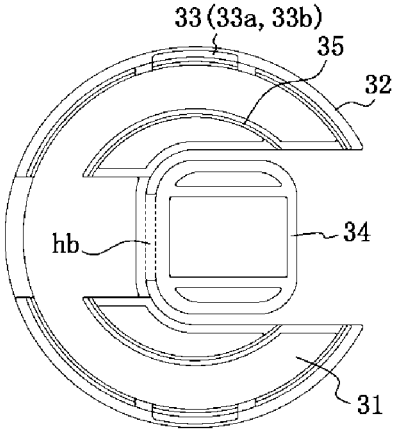
FIG. 8(*a*)-FIG. 8(*c*) illustrate the upper cover shown in FIG. 1(*a*)-FIG. 1(*b*), where FIG. 8(*a*) is a bottom view, FIG. 8(*b*) is a view seen from the direction of arrow J of FIG. 8(*a*), and FIG. 8(*c*) is a view seen from the direction of arrow K of FIG. 8(*a*)
Figure 8:
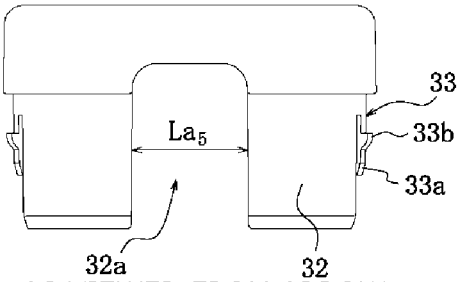
Figure 8:
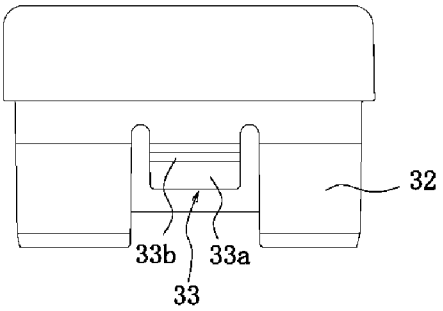
Figure 9:
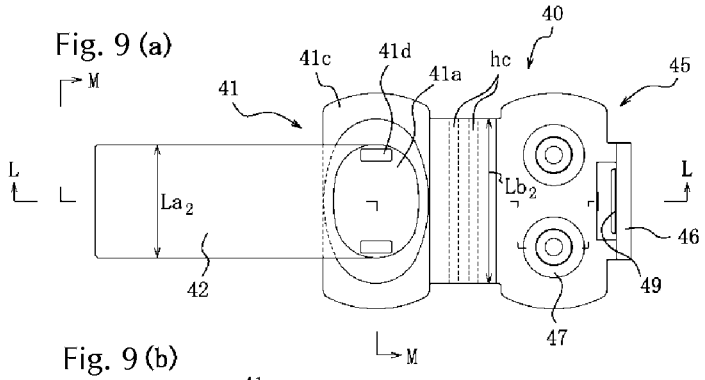
FIG. 9(*a*)-FIG. 9(*d*) illustrate the nozzle shown in FIG. 1(*a*)-FIG. 1 (*b*) before it is bent, FIG. 9(*a*) is a plan view, FIG. 9(*b*) being a cross-sectional view along L-L of FIG. 9(*a*), FIG. 9(*c*) is a half cross-sectional view along M-M of FIG. 9(*a*), and FIG. 9(*d*) is a bottom view.
Figure 9:
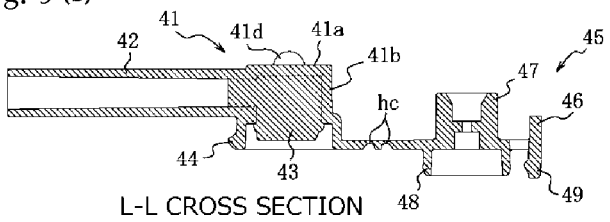
Figure 9:
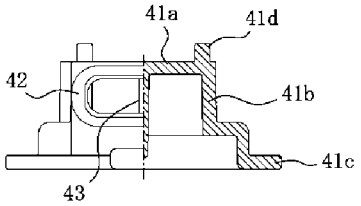
Figure 9:
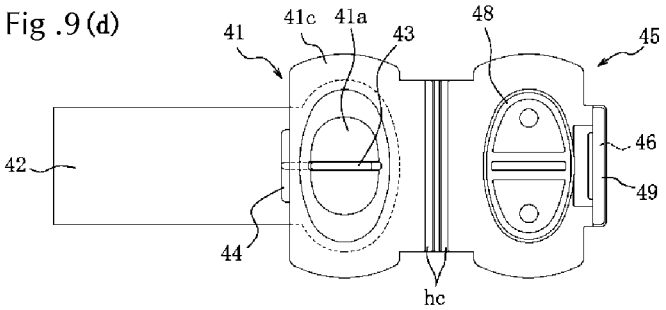
Figure 10:
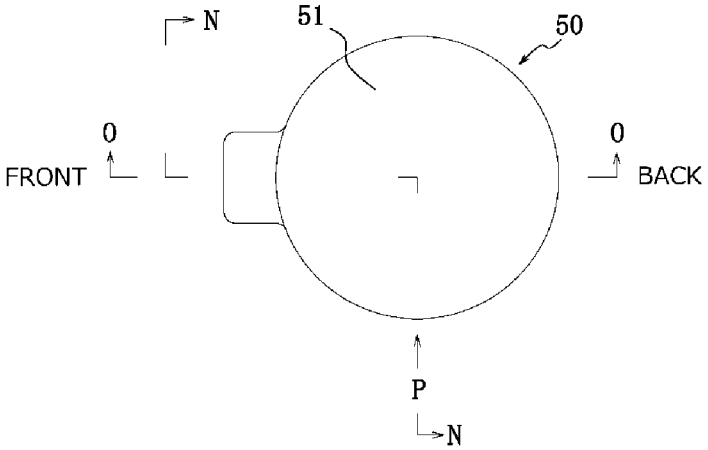
FIG. 10(*a*)-FIG. 10(*c*) illustrate the over cap shown in FIG. 2, where FIG. 10(*a*) is a plan view, FIG. 10(*b*) being a half cross-sectional view along N-N of FIG. 10(*a*), and FIG. 10(*c*) is a cross-sectional view along O-O of FIG. 10(*a*)
Figure 10:
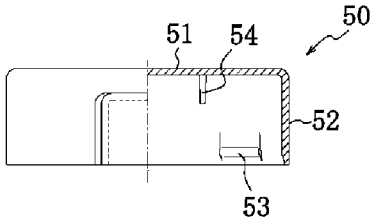
Figure 10:
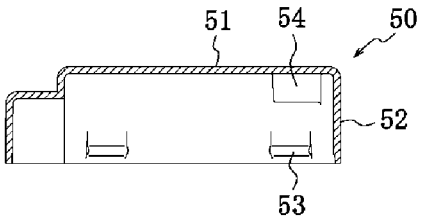
Figure 11:
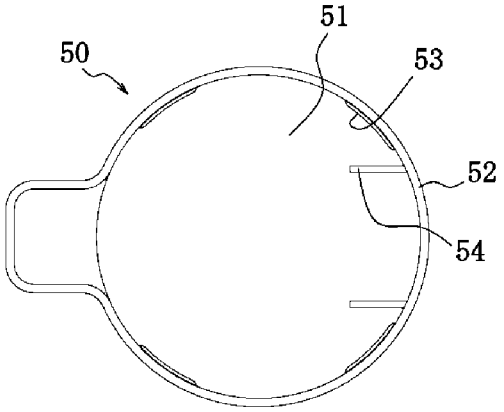
FIG. 11(*a*)-FIG. 11(*b*) illustrate the over cap shown in FIG. 2, where (a) is a bottom view and FIG. 11(*b*) is a view seen from the direction of arrow P of FIG. 11(*a*).
Figure 11:
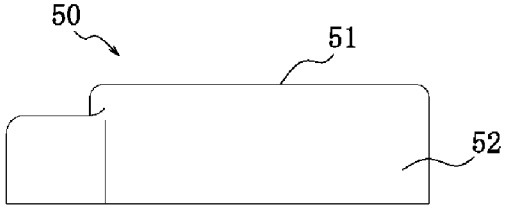

FIG. 1 illustrates an embodiment of the dispenser assembly for an aerosol container according to the present invention in a state in which the assembly is mounted to the container while the over cap is removed, where (a) is a plan view and (b) is a side view. FIG. 2 is an enlarged cross-sectional view of major parts along A-A shown in FIG. 1(*a*). FIG. 3 is an enlarged half cross-sectional view of major parts along B-B shown in FIG. 1(*a*). FIG. 4 illustrates the fixing plate shown in FIG. 1, where (a) is a plan view, (b) is a half cross-sectional view along C-C of (a), (c) is a cross-sectional view along D-D of (a), and (d) is a bottom view. FIG. 5 illustrates the lower cover shown in FIG. 1, where (a) is a plan view, (b) is a half cross-sectional view along E-E of (a), and (c) is a cross-sectional view along F-F of (a). FIG. 6 illustrates the lower cover shown in FIG. 1, where (a) is a bottom view and (b) is a view seen from the direction of arrow G of FIG. 5(*a*). FIG. 7 illustrates the upper cover shown in FIG. 1, where (a) is a plan view, (b) is a cross-sectional view along H-H of (a), and (c) is a half cross-sectional view along I-I of (a). FIG. 8 illustrates the upper cover shown in FIG. 1, (a) is a bottom view, (b) is a view seen from the direction of arrow J of FIG. 7(*a*), and (c) is a view seen from the direction of arrow K of FIG. 7(*a*). FIG. 9 illustrates the nozzle shown in FIG. 1 before it is bent, where (a) is a plan view, (b) is a cross-sectional view along L-L of (a), (c) is a half cross-sectional view along M-M of (a), and (d) is a bottom view. FIG. 10 illustrates the over cap shown in FIG. 2, where (a) is a plan view, (b) is a half cross-sectional view along N-N of (a), and (c) is a cross-sectional view along O-O of (a). FIG. 11 illustrates the over cap shown in FIG. 2, where (a) is a bottom view and (b) is a view seen from the direction of arrow P of FIG. 10(*a*).

The "front" herein refers to an outlet side of a discharge tube provided in the nozzle, while the "back (rear)" refers to the opposite side from the front along the axial line of the discharge tube. The "sides" refer to left and right directions when viewing the container from the front to the back.

In FIG. 1 to FIG. 3, reference numeral 1 denotes a first embodiment of the dispenser assembly for an aerosol container according to the present invention, and reference numeral 2 denotes the aerosol container, to which the dispenser assembly 1 is mounted. The dispenser assembly 1 in this embodiment is formed by a fixing plate 10, a lower cover 20, an upper cover 30, a nozzle 40, and an over cap 50 (the over cap 50 is not shown in FIG. 1). The lower cover 20 and the upper cover 30 form a cover member.

The aerosol container 2 is formed by fixedly attaching a mounting cup 4 made of metal, for example, to a bottomed cylindrical container body 3 made of metal, for example, by crimping the outer edge of the cup (the crimped portion forming an annular rim 5), as shown in FIG. 2, and contains therein two types of contents separately. The aerosol container 2 includes a total of two stems 6 that lead to housing spaces of respective contents. A raised portion 7 that is in the form of a race track in plan view binds the two stems 6 and protrudes in the center of the mounting cup 4. The raised portion 7 may be rectangular or elliptical in plan view.

The fixing plate 10 includes, as shown in FIG. 4(*a*) to FIG. 4(*d*), a tubular upper tier part 12*a* with a top that is generally circular in plan view, a middle tier part 12*b* that extends radially outward from the lower end of the upper tier part 12*a* and downward from the outer edge thereof, and a lower tier part 12*c* that extends radially outward from the lower end of the middle tier part 12*b* and downward from the outer edge thereof (these upper tier part 12*a*, middle tier part 12*b*, and lower tier part 12*c* form an outer wall 12). An inner circumferential wall 12*d* that forms an opening 11 on the inner side thereof is provided in the center of the upper tier part 12*a* as shown in FIG. 4(*c*). The opening 11 has a rounded rectangular shape with arcuate short sides and linear long sides in plan view as shown in FIG. 4(*a*), the long sides positioned in the front and the back. In this embodiment, the long sides of the opening 11 extend so long that part of the inner circumferential wall 12*d* merges with the circumferential wall of the upper tier part 12*a* (see FIG. 4(*b*)).

As shown in FIG. 4(*c*), at the lower end of the inner circumferential wall 12*d* on the inner circumferential side thereof is provided a positioning wall 13 having an inner circumferential shape in the form of a race track in plan view as shown in FIG. 4(*a*). The inner circumferential shape of the positioning wall 13 conforms to the raised portion 7 of the aerosol container 2 and a rectangular or elliptical one may be selected corresponding to the shape of the raised portion 7. (In this embodiment, a total of two) tongues 14 are provided to extend downward from the edges along the long sides of the positioning wall 13. Slits 15 are provided in the upper tier part 12*a*. In this embodiment, two slits are formed in the front and one in the back as shown in FIG. 4(*a*). As shown in FIG. 4(*c*), the middle tier part 12*b* has a tubular wall 16 that extends downward from the backside, and a total of three circumferentially equally spaced claws 16*a* are provided on the inner circumferential surface of the tubular wall 16. Furthermore, a total of two oppositely positioned holes (first engaging holes) 17 are provided at the boundary between the middle tier part 12*b* and the lower tier part 12*c* to extend through the front and back thereof as shown in FIG. 4(*a*).

The lower cover 20 includes a top wall 21 that is generally disc-like and formed with part thereof in the back protruding radially outward in plan view (the protruding part will be referred to as a protruding portion 21*a*), and a circumferential wall 22 connected to the edge of the top wall 21, as shown in FIG. 5(*a*) to FIG. 5(*c*) and FIG. 6(*a*) and FIG. 6(*b*). The lower end, except in the back, of the circumferential wall 22 connects to an outer circumferential wall 24 via a connecting wall 23 that extends horizontally at a lower position than the top wall 21. The top wall 21 includes stepped portions 21*b* in the front and the back thereof, and a pair of upper circumferential walls 21*c* on the sides thereof. The top wall 21 further includes, in the center thereof, a rounded rectangular opening 21*d* with arcuate short sides and linear long sides which is oriented so that the long sides are positioned in the front and the back in plan view.

As shown in FIG. 5(*b*), a pair of first engaging pieces 25 are provided on the sides of the outer circumferential wall 24 to extend downward, the first engaging pieces 25 each having a radially outwardly oriented claw 25*a*. In the middle in the up and down direction on the sides of the outer circumferential wall 24 are provided a pair of pressing portions 26 that are coupled to the wall via a thin hinge ha. A pair of holes (second engaging holes) 27 extending through the front and back of the outer circumferential wall 24 are provided above the pressing portions. A slope 24*a* is provided on the inner circumferential surface of the outer circumferential wall 24, above each second engaging hole 27. Further, protrusions (cover protrusions) 24*b* (a total of four in the front and the back on both sides as shown in FIG. 5(*a*) in this embodiment) that laterally extend are provided on the outer circumferential surface of the outer circumferential wall 24, above the second engaging holes 27.

The upper cover 30 includes a top wall 31 that is generally disc-like, with a cut-out portion 31*a* formed by removing part thereof in the back, in plan view, and a circumferential wall 32 continuous with the rim of the top wall 31, as shown in FIG. 7(*a*) to FIG. 7(*c*) and FIG. 8(*a*) and FIG. 8(*b*). The circumferential wall 32 includes a cut-out portion 32*a* in the front in the lower part thereof (see FIG. 8(*b*)). The circumferential wall 32 also includes second engaging pieces 33 on both sides, these second engaging pieces 33 each including a radially outwardly oriented claw 33*b*, and a pressure receiving portion 33*a* extending downward from the claw 33*b*. Further as shown in FIG. 7(*a*), the cut-out portion 31*a* of the top wall 31 is provided with an operation part 34 that is connected to the cut-out portion 31*a* via a thin hinge hb and discharges the contents from the nozzle 40 when depressed downward. While the upper face of the operation part 34 in the illustrated example is positioned generally coplanar with the upper face of the top wall 31, the upper face of the operation part 34 may be located lower than the upper face of the top wall 31. Alternatively, it may be located higher than the upper face of the top wall 31, to the extent that the nozzle 40 will not be pushed in when the over cap 50 is attached. While the upper face of the operation part 34 is flat here, it may be curved downward in the center so as to give a good feel on the finger tip. An inner circumferential wall 35 is formed on the backside of the top wall 31, as shown in FIG. 7(*c*).

The nozzle 40 is made up of an upper member 41 and a lower member 45 that are united via a thin hinge hc as shown in FIG. 9(*a*) to FIG. 9(*d*) and the nozzle assumes the form shown in FIG. 2 and FIG. 3 when bent at the hinge hc.

The upper member 41 includes a top wall 41*a* that is elliptical in plan view, a circumferential wall 41*b* continuous with the rim of the top wall 41*a*, and a flange 41*c* extending outward from the lower end on both sides of the circumferential wall 41*b*, as shown in FIG. 9(*a*). A total of two semi-circular ribs 41*d* that are semi-circular in side view are provided on the top wall 41*a*. A discharge tube 42 having a generally quadrate tubular cross-sectional shape is integrally connected to the front of the upper member 41. A partition wall 43 is provided to a portion where the upper member 41 and the discharge tube 42 are connected together. A claw 44 is provided to a lower portion of the discharge tube 42.

The lower member 45 is generally planar and has a tab 46 formed in the back thereof as shown in FIG. 9(*b*). On the front side of the lower member 45 are provided a total of two tubular connection parts 47, while on the backside, there are annular walls 48 that form, together with the circumferential wall 41*b*, a passage R (see FIG. 3) continuous from the connection parts 47 to the outlet of the discharge tube 42 when the nozzle is folded over, and a claw 49 that engages the claw 44 to maintain the folded shape.

The over cap 50 includes a top wall 51 that is generally disc-like, with part thereof in the front being stepped and protruding radially outward, in plan view, and a circumferential wall 52 continuous with the rim of the top wall 51, as shown in FIG. 10(*a*) to FIG. 10(*c*) and FIG. 11(*a*) and FIG. 11(*b*). Radially inwardly protruding protrusions (cap protrusions) 53 (a total of four in the front and the back on both sides in this embodiment), and a pair of positioning ribs 54 spaced apart in the back, are provided on the inner circumferential surface of the circumferential wall 52.

Next, the process of mounting the fixing plate 10, lower cover 20, upper cover 30, nozzle 40, and over cap 50 that are configured as described above, to the aerosol container 2 will be described with reference to FIG. 2 and FIG. 3.

First, the fixing plate 10 is mounted to the mounting cup 4. Here, if the track-like shape of the positioning wall 13 shown in FIG. 4(*a*) is aligned with the raised portion 7 of the aerosol container 2, the fixing plate 10 is to go all the way down to a height where the tips of the tongues 14 abut on the lower end of the raised portion 7. If, however, they are misaligned with each other, the fixing plate 10 will be located higher than a predetermined height because the tips of the tongues 14 will abut on the upper face of the raised portion 7. Namely, whether they are aligned with each other or not can be determined based on the difference in height of the fixing plate 10, so that the assembling work is made easier. Since the fixing plate 10 moves down when the positioning wall and the raised portion are aligned with each other during the rotation of the fixing plate 10, also the completion of positioning can be recognized by tactile sensation. The fixing plate 10 may be pushed in afterwards, which will cause the tongues 14 to bend outward as shown in FIG. 2 and allow the claws 16*a* to engage the annular rim 5.

Next, with the first engaging pieces 25 of the lower cover 20 being aligned with the first engaging holes 17 of the fixing plate 10, the lower cover 20 is pressed into the fixing plate 10 to join them together. Although omitted in this embodiment, ribs that fit in the slits 15 of the fixing plate 10 shown in FIG. 2 and FIG. 4(*a*) may be provided on the backside of the lower cover 20, so that a backward attachment of the lower cover 20 can be prevented reliably. For preventing reverse attachment, at least one such rib may be provided.

Then, the connection parts 47 of the nozzle 40, which is folded over from the form shown in FIG. 9 into the form shown in FIG. 2 and FIG. 3, are fitted to the stems 6 of the aerosol container 2, with the discharge tube 42 oriented to the front. Here, the nozzle 40 is located inside of the upper circumferential wall 21*c* of the lower cover 20 as shown in FIG. 3. The upper circumferential wall 21*c* has a smaller width ($La_1$) on the front side than the width ($Lb_1$) on the back side as shown in FIG. 5(*a*). Similarly, the nozzle 40 has a smaller width ($La_2$) on the front side than the width ($Lb_2$) on the back side as shown in FIG. 9(*a*). Since they are formed to satisfy a relationship of $Lb_2>La_1$, a backward attachment of the nozzle 40 can be prevented reliably.

After that, with the second engaging pieces 33 of the upper cover 30 being aligned with the second engaging holes 27 of the lower cover 20, the upper cover 30 is pressed into the lower cover 20 to join them together. Here, the width ($La_4$) of the cut-out portion 31*a* of the upper cover 30 shown in FIG. 7(*a*) is wider than the width ($La_3$) of the protruding portion 21*a* of the lower cover 20 shown in FIG. 5(*a*), while the width ($La_5$) of the cut-out portion 32*a* shown in FIG. 8(*b*) is narrower than $La_3$ ($La_4>La_3>La_5$). Therefore, if an attempt is made to attach the upper cover 30 backwards, the circumferential wall 32 of the upper cover 30 will abut on the protruding portion 21*a* of the lower cover 20 and prevents the attachment, so that the upper cover can be attached in the intended orientation reliably. In this embodiment, also, the slopes 24*a* provided above the second engaging holes 27 as shown in FIG. 3 allow the second engaging pieces 33 to smoothly bend flexibly radially inward as they are inserted, which enables attachment with even a smaller pressing force. When mounting the upper cover 30, the inner circumferential wall 35 may be contacted along the upper circumferential wall 21*c* of the lower cover 20, so that the inner circumferential wall 35 and the upper circumferential wall 21*c* can function as a guide when mounting the upper cover.

After that, the over cap 50 is attached on the upper cover 30. As the cap protrusions 53 of the over cap 50 engage the cover protrusions 24*b* of the lower cover 20 as shown in FIG. 3, and as the positioning ribs 54 formed on the backside of the over cap 50 fit in the cut-out portion 31*a* of the top wall 31 of the upper cover 30, the over cap 50 is held in the predetermined position. Since the cover protrusions 24*b* and cap protrusions 53 are formed in the front and the back on both sides as mentioned above, the over cap 50 is prevented from tilting forward, backward, or sidewards and held more stably. The cover protrusions may be formed on the upper cover 30.

To attach the fixing plate 10 and others to the aerosol container 2, the lower cover 20, nozzle 40, upper cover 30, and over cap 50 may be successively attached to the fixing plate 10 in advance, and these may then be mounted to the aerosol container 2. Alternatively, the fixing plate 10, lower cover, nozzle, and upper cover 30 may be assembled together first, and then attached to the aerosol container 2, after which the over cap 50 may be mounted.

To discharge the contents from the aerosol container 2 through the dispenser assembly thus assembled, the over cap 50 is first removed. Then the operation part 34 of the upper cover 30 is pressed downward, so that the operation part 34 abuts on the semi-circular ribs 41*d* of the nozzle 40, whereby the stems 6 connected to the nozzle 40 are pressed down. This way, the two types of contents are ejected simultaneously from the respective stems 6, and discharged through the passage R formed inside the nozzle 40 and from the outlet of the discharge tube 42. In this embodiment, the partition wall 43 provided inside the nozzle 40 divides only the upstream side of the passage R into two sections (the upstream side of the passage R being the side closer to the stems 6, while the downstream side being the side closer to the outlet of the discharge tube). Depending on the types of the contents, however, the partition wall 43 may be extended as far as to near the outlet of the discharge tube 42 to divide the passage R generally entirely (so that two passage portions are formed inside one discharge tube 42), or, may be made shorter on the upstream side so that a smaller area is divided than in this embodiment, or, the partition wall 43 may be removed so that no area is divided.

To clean the passage R, the upper cover 30 can be removed by pressing in the pressing portions 26 of the lower cover 20 radially inward, because the backside of each pressing portion 26 pushes on the pressure receiving portion 33*a* of the upper cover 30 as shown in FIG. 3 and allows the second engaging pieces 33 of the upper cover 30 to be disengaged from the second engaging holes 27 of the lower cover 20. After that, by pulling up the nozzle 40 to remove it from the stems 6 as shown in FIG. 2, and by tilting the tab 46 toward the connection parts 47 to disengage the claw 44 from the claw 49, the nozzle 40 can be opened up, so that the inside of the nozzle 40 can be cleaned with ease. The tab 46 is not limited to the illustrated form and may be of any shape as long as it lets the finger to take hold of the nozzle 40 when it is to be opened.

INDUSTRIAL APPLICABILITY

According to the present invention, it is possible to provide a novel dispenser assembly for an aerosol container, which can readily be mounted to an aerosol container with two stems and allows the passage of the contents to be cleaned easily.

The invention claimed is:

1. A dispenser assembly for an aerosol container, the assembly comprising:

a fixing plate mounted to a mounting cup of the aerosol container that has two stems;

a nozzle having two connection parts that respectively lead to the stems, and discharging contents from each of the stems through one discharge tube via a passage provided inside the nozzle; and a cover member having an operation part for pressing the nozzle and held by engagement with the fixing plate such as to cover the nozzle, wherein the cover member includes a lower cover located immediately above the fixing plate and having a first engaging piece that engages with a first engaging hole provided to the fixing plate, and an upper cover having the operation part and a second engaging piece that engages with a second engaging hole provided to the lower cover, and the lower cover has a pressing portion that is supported via a hinge and pushes on the second engaging piece to disengage the second engaging piece from the second engaging hole.

2. The dispenser assembly for an aerosol container according to claim 1, wherein the nozzle is a two-piece structure in which a lower member provided with the connection parts and an upper member provided with the discharge tube are connected via a hinge such as to be opened and closed.

3. The dispenser assembly for an aerosol container according to claim 1, further comprising an over cap immediately above the upper cover to cover the discharge tube of the nozzle and the operation part.

4. The dispenser assembly for an aerosol container according to claim 3, wherein the over cap includes a cap protrusion that detachably engages with a cover protrusion that is provided to the upper cover or the lower cover, the cap protrusion being provided at four positions, in the front and the back on both sides of an axial line of the discharge tube.

* * * * *